US005636450A

United States Patent [19]

Lizé

[11] Patent Number: 5,636,450

[45] Date of Patent: Jun. 10, 1997

[54] CONTACT-FREE DIVERTING DEVICE FOR SHEET MATERIAL

[75] Inventor: Grégoire Liz´´, Lyons, France

[73] Assignee: Infra Rouge System, Vaulx-En-Velin, France

[21] Appl. No.: 624,579

[22] PCT Filed: Oct. 5, 1994

[86] PCT No.: PCT/FR94/01165

§ 371 Date: Apr. 3, 1996

§ 102(e) Date: Apr. 3, 1996

[87] PCT Pub. No.: WO95/10012

PCT Pub. Date: Apr. 13, 1995

[30] Foreign Application Priority Data

Oct. 6, 1993 [FR] France ..... 93 12095

[51] Int. Cl.[6] ..... F26B 3/34

[52] U.S. Cl. ..... 34/267; 34/273; 34/111; 34/115; 226/97

[58] Field of Search ..... 34/267, 273, 465, 34/110, 111, 125, 68, 115; 226/97, 196

[56] References Cited

U.S. PATENT DOCUMENTS

| | | | |
|---|---|---|---|
| 3,722,105 | 3/1973 | Marteny | 34/254 |
| 4,218,833 | 8/1980 | Coar | 34/641 |
| 4,513,516 | 4/1985 | Björnberg | 34/266 |
| 4,854,052 | 8/1989 | Korpela | 34/68 |
| 4,882,852 | 11/1989 | Kautto | 34/273 |
| 4,918,828 | 4/1990 | Ruotto et al. | 34/273 |
| 4,942,675 | 7/1990 | Sundovist | 34/421 |
| 5,092,059 | 3/1992 | Wimberger et al. | 34/641 |
| 5,199,623 | 4/1993 | Rajala et al. | 34/641 X |

FOREIGN PATENT DOCUMENTS

| | | |
|---|---|---|
| 2126974 | 9/1982 | United Kingdom . |

*Primary Examiner*—John M. Sollecito
*Assistant Examiner*—Steve Gravini
*Attorney, Agent, or Firm*—Herbert Dubno; Andrew Wilford

[57] ABSTRACT

A device for diverting sheet, web or mat material treated continuously uses an air cushion (6) formed about a cylindrical surface (4). Infrared transmitters (7), whose radiation is directed to a portion of the material (1) being diverted, are provided in or under the cylindrical surface (4), in addition to the air-blowing means (5) generating the air cushion (6). The same volume therefore houses means for diverting the material (1) and means for heating it, especially in order to dry it. At the same time that the blown air flow generates the air cushion (6), it also cools the infrared transmitters (7). Application, in particular, in the manufacture, transformation and treatment of materials such paper, fabric and synthetic film.

6 Claims, 1 Drawing Sheet

CONTACT-FREE DIVERTING DEVICE FOR SHEET MATERIAL

CROSS REFERENCE TO RELATED APPLICATIONS

This application is the US national phase of PCT application PCT/FR94/01165 filed 5 October 1994 with a claim to the priority of French application 93/12095 filed 6 October 1993.

FIELD OF THE INVENTION

The present invention relates to a contact-free diverting device for sheet material, this device being of the type using an air cushion around a generally cylindrical surface located where the sheet material being treated "on the fly" should be diverted. These diverting devices are known for example from British patent document 2,126,974 and European patent document 0,507,218.

BACKGROUND OF THE INVENTION

This invention relates to a technical field of fabrication, conversion, and treatment of sheet material as a strip or web such as paper, cardboard, textile, plastic film, etc. which moves in an industrial machine or installation where the sheet, strip, or web is subjected to a certain number of changes of direction along the path that it follows past succeeding treatment stations; the contact-free diversion, thanks to the air cushion, preventing friction or marking.

The machines or installations of this type often are provided with heaters constituted as emitters of infrared rays and are used mainly for drying, for example drying of ink in the case of printing machines, or the elimination of water in paper-making installations, this type of emitter allowing for rapid temperature increases with excellent all-around applicability (no thermal inertia). The dryers using infrared radiation are normally provided at straight sections along the path of the sheet material, between two succeeding diverting rollers of the contact or contact-free type (see for example EP 0,346,081, WO 8,795,644, and French 2,247,687 as well as above-cited European 0,507,218). The result is that the machines or installations in question are in fact very bulky, the deflecting rollers form large elements that do nothing to the sheet material, strip, or web being treated "on the fly."

OBJECT OF THE INVENTION

It is an object of the invention to avoid this disadvantage with a technical solution making the contact-free diverting elements active so as to reduce the size of the machines or installations incorporating them and increasing production speed while improving or increasing the efficiency of the infrared-ray heating/drying units.

SUMMARY OF THE INVENTION

To this end the object of the invention is a contact-free diversion device for sheet material of the type described in the introduction and provided on or underneath the cylindrical surface, in addition to the blowing means creating the air cushion for contact-free diversion, with infrared emitters whose radiation is directed radially outward of said cylindrical surface toward that portion of the sheet material being diverted around this cylindrical surface, the pressurized air flow cooling the infrared emitters while forming the air cushion.

Thus the device according to the present invention ensures that within the same space the sheet material is diverted and also treated thermally, that is heated with infrared radiation. Putting the two functions in the same place produces a considerable saving of space for the machines and installations in question which can thus be built to be much more compact.

In addition by combining the blowing means with the infrared-radiation emitters the instant invention improved the operation of these emitters and increases their service lives since the air passing over them cools these infrared emitters while forming the air cushion. In addition in the case where the infrared emitters are being used for drying, the air flow itself contributes to the drying of the sheet material so that this drying is improved without increasing the overall energy requirements.

In a particular embodiment the diverting device according to the invention has a multiplicity of infrared emitters arrayed in rows and/or columns over said cylindrical surface, apertures for the pressurized air being formed between the infrared emitters.

The infrared-radiation emitters typically formed as a tube set at the focal point of a reflector can get dirty in particular in the production of paper. It is thus useful to protect them against foreign matter. This associated problem is resolved with the contact-free diverting device according to the invention by providing around the cylindrical surface a rounded protection screen of material transparent to infrared radiation such as quartz glass preferably fixed but removable and provided with apertures or gaps for the passage of the air flow emitted by the blowing means.

In any case the invention will be better understood with the help of the description that follows, with reference to the attached schematic drawing showing by way of example two embodiments of this contact-fee diverting device for sheet material.

SPECIFIC DESCRIPTION

Figure 1:
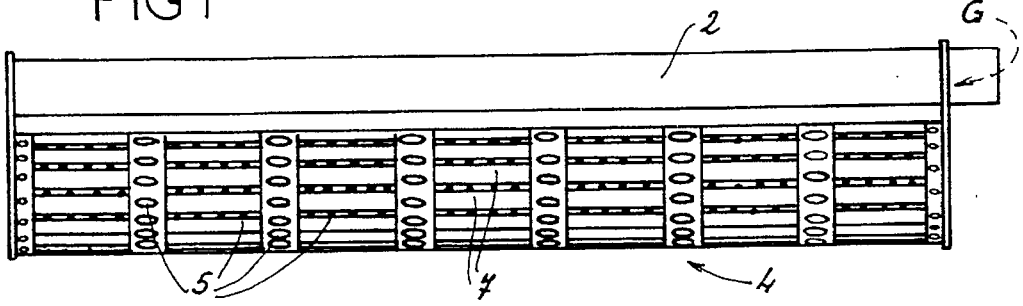
FIG. 1 is a front view of a device according to the invention.
Figure 2:
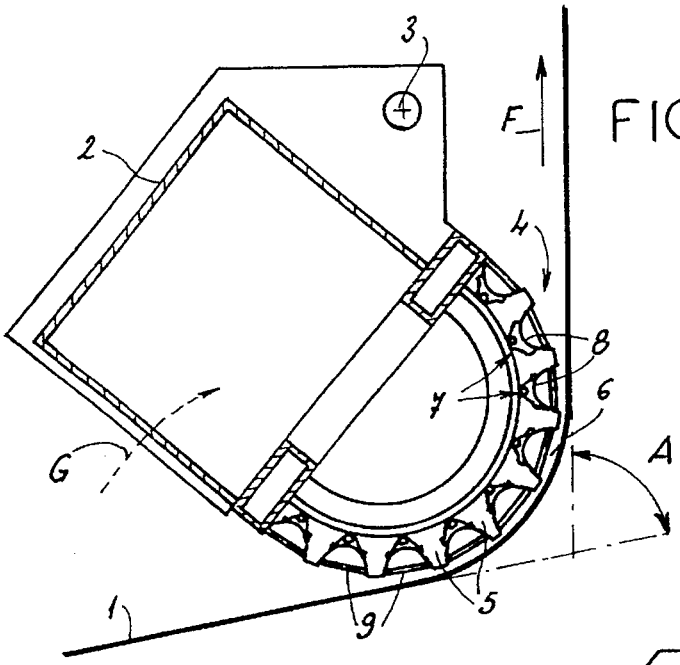
FIG. 2 is a large-scale cross section through the device of FIG. 1.

The device of which a first embodiment is shown in FIGS. 1 and 2 serves in a machine or piece of industrial equipment for the diversion through an angle A of a sheet 1 being treated "on the fly" and moving as shown by arrow F. This device also serves for heating the sheet 1 in the region where it is being diverted mainly to dry this material 1 during a manufacture, conversion, or treatment process.

The device has a housing 2 that is elongated horizontally and that can be mounted for rotation about a horizontal axis 3. The interior of the housing 2 is supplied with air under pressure by the appropriate means as indicated schematically by arrow G.

In its front part the housing 2 forms a cylindrical surface 4, actually a semicylinder, having horizontal generatrices. Openings 5 are distributed all over the cylindrical surface 4 to form jets of air that create an air cushion 6 between this cylindrical surface 4 and the portion of the sheet 1 being diverted around it. The air pressure is controlled by known unillustrated means to provide good tension in the sheet material 1.

Electrical infrared-radiation emitters 7 are mounted in the cylindrical surface 4, arrayed in columns and rows over the generally semicylindrical contours of this cylindrical surface 4. Each infrared emitter 7 has a reflector 8 directing the infrared radiation radially outward, that is toward the portion of the sheet material 1 being diverted around the air cushion 6. The emitters 7 which are of known construction can according to application generate "short" or "long" (wave lengths between 0.8 m and 10 m) infrared radiation. The openings 5 emitting the air jets that form the air cushion 6 are arranged in the spaces between the infrared emitters 7.

When the air flow contacts the infrared emitters 7 it is heated, for example from an ambient temperature of 20° C. to a temperature around 100° C. which cools the infrared emitters 7 while improving the drying of the sheet material 1.

As shown more particularly in FIG. 2 the device is provided with a protection screen 9 formed of quartz glass that is transparent to infrared radiation and of the same generally semicylindrical shape as the cylindrical surface 4. The rounded protection screen 9 is here formed of small sheets of quartz glass mounted in front of the infrared emitters 7 to protect them from getting dirty, the small sheets being separated from one another by spaces which correspond to the openings 5 through which the pressurized air exits.

Figure 3:
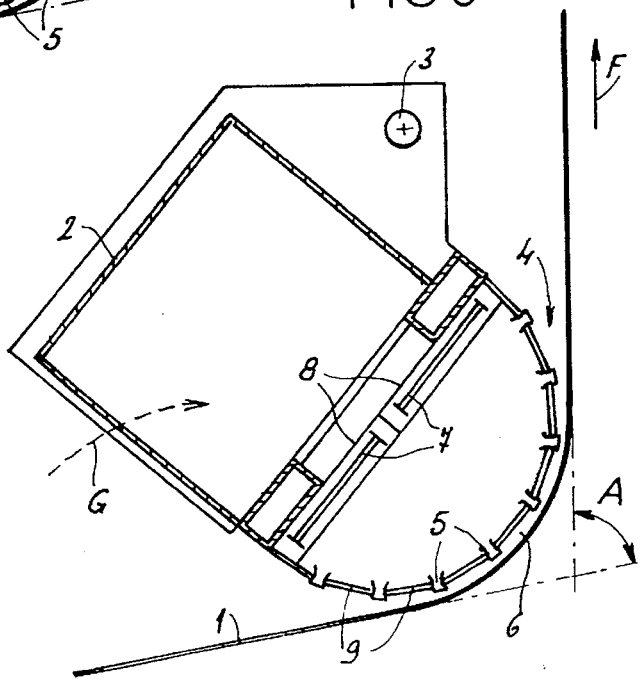
FIG. 3 is a view like FIG. 2 showing a variant on this device.

FIG. 3 shows another embodiment of the invention in which the infrared emitters 7 are mounted under the cylindrical surface 4 extending along a diametral plane. These emitters are always positioned such that their radiation is directed radially outward of the cylindrical surface 4 toward that portion of the sheet material 1 being diverted around the air cushion 6. A rounded protection screen 9 of quartz glass that is transparent to infrared radiation is mounted here on the cylindrical surface 4 in front of the infrared emitters 7. The protection screen 9 is formed with imperforate regions between which are provided the apertures 5 for blowing out air. This protection screen 9 is fixed on but removable from the housing 2 so as to be easily and quickly changed.

It goes without saying that the invention is not limited to the embodiments of the contact-free diverting device for sheet material that have been described above by way of example; it includes on the contrary all variations on construction and application using the same principle. Thus one would not leave the scope of the invention by modifying the number, orientation (for example in staggered rows) or the density of the infrared emitters according to how much total wattage is needed and the wattage of the individual emitters;

by providing for the infrared emitters any type of operation, for instance continuous or intermittent;

by setting the device to any desired diversion angle for the sheet material;

by using the diverting device for a sheet material, a strip, or a web of any type—paper, cardboard, fabric, layered material, plastic film, etc.—and by building this device into any type of machine or installation for making, converting, or treating in any manner.

I claim:

1. In a system where a continuous web moves along a path and is diverted through an angle at a location along the path, a diverting device comprising:

a housing at the location and having a generally part-cylindrical surface directed at the web and around which the web is diverted;

an array of nozzles on the surface;

means including at least one emitter of infrared radiation mounted on the housing and directed outward from the surface at the web for heating the web; and blowing means connected to the housing for creating jets of air exiting from the nozzles, cooling the emitters, and forming an air cushion between the surface and the web holding the web out of contact with the surface.

2. The diverting device defined in claim 1 wherein the housing is formed with an array of apertures forming the nozzles and is provided with a plurality of the emitters interspersed with the apertures.

3. The diverting device defined in claim 2 wherein the apertures and emitters are in uniform interfitting arrays.

4. The diverting device defined in claim 3 wherein the emitters are provided on the surface between the apertures.

5. The diverting device defined in claim 4, further comprising screens transparent to infrared radiation between the apertures and over the emitters, whereby the screens keep the emitters from getting dirty.

6. The diverting device defined in claim 1 wherein the surface is formed of a screen transparent to infrared radiation and formed with apertures forming the nozzles, the emitter being provided inside the housing behind the screen.

* * * * *